United States Patent [19]

Kandakov et al.

[11] 4,003,695

[45] Jan. 18, 1977

[54] STOVE OF BLAST FURNACE

[76] Inventors: Gennady Petrovich Kandakov, Sevastopolsky prospekt, 51, korpus 2, kv. 163, Moscow; Albert Nikolaevich Zharikov, ulitsa Kosiora, 64, kv. 37, Dnepropetrovsk, both of U.S.S.R.

[22] Filed: June 3, 1975

[21] Appl. No.: 583,245

[52] U.S. Cl. ..... 432/219; 432/214; 432/252

[51] Int. Cl.[2] ..... F24H 1/00; F27B 1/14

[58] Field of Search ..... 432/214, 216, 217, 218, 432/219, 252; 110/1 A

[56] References Cited

UNITED STATES PATENTS

| | | | |
|---|---|---|---|
| 3,057,148 | 10/1962 | Kimpel et al. | 110/1 A |
| 3,120,380 | 2/1964 | Durham et al. | 432/214 |
| 3,528,647 | 9/1970 | Hyde | 432/252 |

*Primary Examiner*—John J. Camby

[57] ABSTRACT

A stove comprises a metal jacket the inner surface of which has a gunite coating with a layer of metal or a heat-resistant synthetic material sprayed on the surface of said coating to form a continuous gastight cover. The gastight cover is superimposed by heat-insulating and refractory layers. The heat-insulating layer immediately adjacent to the gastight cover is made of kaolin wool which protects the cover against mechanical damage.

4 Claims, 2 Drawing Figures

STOVE OF BLAST FURNACE

Figure 1:
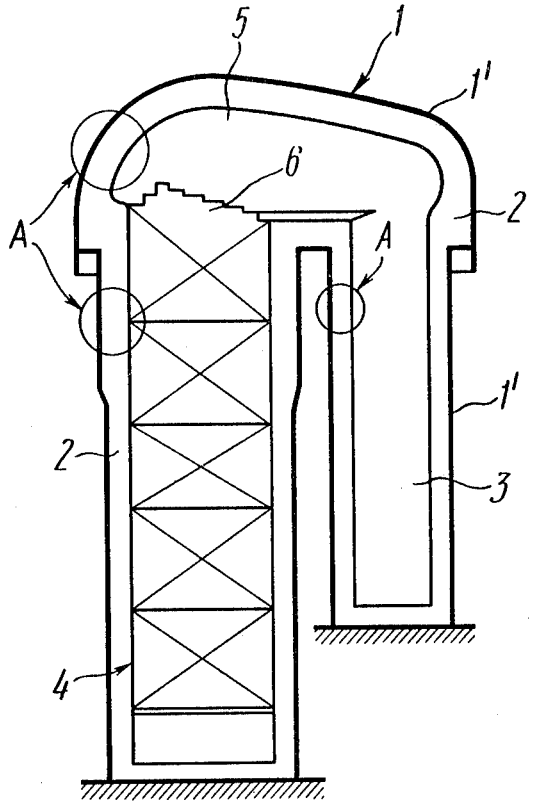

The present invention relates to an advanced blast furnace and, more precisely, to stoves of the blast furnace.

The stoves are provided to heat the air which is fed into the blast furnace. The temperature of blasting at modern blast furnaces reaches as much as 1,400° C, with the pressure of blasting from 3 to 5 kg/sq.cm.

The stove comprises an outer jacket of metal sheet and an inner lining made of heat-insulating and refractory materials.

The structure and thickness of the inner lining depend on the maximum operating blast temperature and on the most admissible temperature of heating of the metal jacket. Normally, the operating temperature of the jacket exceeds the ambient temperature by 20°–50° C.

The inner lining is not gastight therefore water vapor and various gases penetrate through it from the inner working space of the stove; when reaching the inner surface of the jacket these gases and water vapor are condensed on it in the form of solutions of different acids and alkalies.

The water vapor gets into the working space of the stove together with the air blast and also from the heating gas which is consumed for heating the lining. During burning of the heating gas an additional amount of moisture appears due to the presence of hydrogen in the stove's working space.

In addition, not all water evaporates from the lining and mortars used for lining operations during construction and in the period of drying and warming-up of the stove before its commissioning. Therefore the remaining amount of the moisture penetrates through the lining in the direction of the outer metal jacket and is condensed on it as water.

It is known that water causes considerable corrosion of steels of which the jackets of stoves are usually made. The corrosion effect of water is, however, intensified by chemical agents which get into the working space of the stove together with the heating gas and air blast, and which are also generated as a result of gas burning. For example, alkalies, chlorine and sulfur compounds get into the stove together with gas, dust and air. During the burning of heating gas, which is taking place with the excess of air and oxygen, alkalies, chlorine and sulfur compounds are being oxidized. Combined with the condensed water on the inner surface of the metal jacket they form a variety of corrosive solutions, causing its general or local corrosion. Recent observations have shown that at a high temperature of blasting nitrogen gets oxidized, too. The oxidation of nitrogen begins at temperatures of from 1,150° to 1,200° C, and it increases with a further increase in the blasting temperature. In combination with water nitrogen oxides form corresponding acids which also cause general and local corrosion of the inner surface of the jacket.

Corrosion can expand over very large areas, practically in all zones of the stove where the temperature of the jacket is below the dew point for water and the above-mentioned corrosive solutions. In the points of the jacket where internal stresses are high the processes of corrosion proceed especially rapidly (in the stress concentrators within regions of weld seams as well as in places where the jacket deviates from its proper geometrical shape). Intercrystalline corrosion which gives rise to a rapid fracturing and cracking in the metal jacket is taking place under a simultaneous impact of the corrosive medium and high internal stresses complemented by a cyclic nature of loads brought about by special features of the stove operation under varied blasting and heating conditions.

Several techniques are known to prevent damages caused by corrosion, e.g., the painting or metallization of the inner surface of the metal jacket, the use of jackets made of acid-and-alkali-resistant steels, an increase in the temperature of the jacket above the dew point of potential condensates, etc. However, all of them are either insufficiently reliable or unjustifiably expensive. Recently it has become a common practice to shotcrete the inner surface of the metal jackets of stoves with a special compound (a mixture of mortar, cement, and asbestos with water) over a metal gauze secured to the jacket. The thickness of this gunite coating is in the range of 60–100 and it has a sufficiently good adhesion to the metal jacket and does not crack in the process of operation.

The applying of gunite coating on the inner surface of the jacket undoubtedly slows down the propagation rate of corrosion and at the same time reliably protects the jacket from being overheated when there emerge local defects in the lining. Gunite coatings are applied as a continuous layer, as a rule, in the stoves' zones with high temperatures. However, in case of a high pressure of the air blast (up to 5 kg/sq. cm.) a gunite coating which has considerable porosity cannot be regarded as a sufficient protection against the penetration of some amount of water vapor and corrosive elements to the inner surface of the metal jacket.

One of the further relatively simple and sufficiently effective methods of protection against corrosion is the provision of a gastight cover in the form of metal or heat-resistant synthetic foil between the heat-insulating layers of the lining. Such a foil cover works at temperatures over 180°–200° C i.e., higher than the dew point of corrosive vapor and, while it prevents the corrosive condensates from penetrating to the jacket, it, thus, protects itself from corrosion, as well.

A shortcoming of such a design lies in the fact that the foil cover is composed of separate sheets which must be glued together to provide the desired gastightness. This is a very delicate and time-consuming job, as the finest sheets of foil which must be glued together on an area of 1,500–2,000 sq.m. during the construction of one stove must be handled with the greatest care. Practically, the integrity of these foil sheets can be damaged even during the erection of the stove. There is also a possibility of untight glue joints. All this substantially reduces the gastightness of the foil cover and, consequently, the reliability of jacket protection. Besides, due to temperature movements in the hot lining, some ruptures may occur in the foil cover during the operation process. The expediency of compensators in the form of folds and corrugations on the foil sheets is dubious taking account of significant radial compressive stresses (from 2 to 7 kgf/sq.cm) acting between all layers of the lining. This leads to a crumpling of folds and corrugations, and, as the foil will be tightly pinched between the heat-insulating layers, this can result in breaking the foil sheets. Thus, the provision of compensators practically gives no advantages.

The object of the invention is the creation of a stove of the blast furnace wherein a more reliable protection of the jacket from the impact of corrosive condensates can be ensured.

Another object of the present invention is to make the design of the gastight cover simpler and cheaper.

These and other objects and advantages are achieved by the fact that in the stove of the blast furnace with a metal jacket and inner lining which comprises a gunite coating, heat-insulating layers with a gastight cover, placed over one of the heat-insulating layers, and refractory layers said gastight cover, according to the invention, is provided in the form of a layer of a metal or heat-resistant synthetic material sprayed on the surfce of the gunite coating.

Such a design of the gastight cover makes it possible to more reliably protect the metal jacket from water vapor and gases which penetrate from the working space of the stove to the metal jacket through the lining. Due to this, the carrying capacity of the metal jacket is preserved for a longer period.

The thickness of the gunite coating is chosen so that the gastight cover sprayed on its surface should work in a zone of temperatures higher than the dew point of the corrosive vapor. In order to prevent any possibility of mechanically breaking the integrity of the gastight sprayed cover it is highly expedient to place a layer of an elastic, soft, heat-insulating and readily-strained material, for instance, kaolin wool, over the sprayed layer which, in the process of its formation, is densely connected with the surface of the gunite coating, closing all its surface pores.

Figure 2:
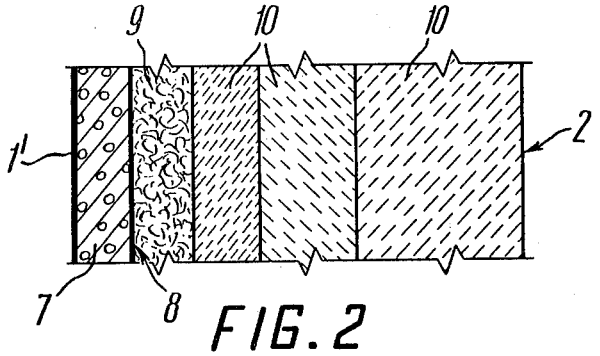

The invention will further be explained by a particular embodiment thereof, with reference to the accompanying drawings, wherein:

FIG. 1 shows the structure of the stove (longitudinal section);

FIG. 2 — unit A in FIG. 1.

A stove 1 denoted as a whole (FIG. 1) comprises an outer metal jacket 1' and an inner lining 2. Said stove 1 comprises a combustion chamber 3, a checkerwork chamber 4 and a dome 5 common for them. The burning of heating gas occurs in the combustion chamber 3, as a result of which porous refractory blocks 6 filling said checkerwork chamber 4 are heated. As FIG. 2 shows, said lining 2 comprises a gunite coating 7 which is a mixture of refractory mortar, asbestite and cement with water. Said gunite coating 7 is applied on a metal gauze (not shown) secured to the inner surface of said metal jacket 1'. A gastight cover 8 in the form of a continuous sprayed layer of metal or a synthetic material is provided on the inner surface of said gunite coating 7, perfectly repeating the shape of this surface.

Aluminum, zinc or a synthetic material, e.g., silicone compounds of the type of heatproof enamels are, for example, used as materials for spraying. These materials are applied on the surface of the gunite coating by means of devices of the known design for electric-arc or gas-plasma metallization or with the help of conventional paint-sprayers in 3–4 operations. The thickness of the layer which is sprayed in one operation is from 60 to 80 $\mu$.

The gastight cover 8 is followed by a layer 9 made of an elastic, soft, readily-strained heat-insulating material, for example, of kaolin wool, over which there are several layers of refractory materials 10 made, for instance, of refractory brick. The composition of kaolin wool includes $Al_2O_3$ and $SiO_2$.

In the operating condition "heating" the refractory blocks 6 positioned in said checkerwork chamber 4 are heated as a result of the burning of heating gas in said combustion chamber 3. In the operating condition "blasting" the air passing through the checkerwork chamber 4 takes the heat from the refractory blocks 6 and is fed in a heated state into the blast furnace. Under both operating conditions of said stove 1 the water vapor, gases and dust particles penetrate, through said lining 2, to said gastight layer 8 which, due to an appropriate selection of the thickness of the gunite coating 7 and said layer 9 is in the range of temperatures from 180° to 300° C. Thus, the water vapor and gases do not cool down below 180° C, that is, below the dew point and are not able to reach the cooler zone of said jacket 1'. The gastight layer 8 which, in the process of its formation, is intimately in contact with the surface of the gunite coating 7 and closes all its surface pores, is a continuous layer and has no seams (including glue ones) on the entire protected surface of the stove 1. The surface of said gunite coating 7 to be metallized does not require preliminary preparation, but in the process of metallization it must be protected against precipitation and must have a temperature not lower than minus 5° C.

The spraying of the gastight layer which forms the cover 8 with silicone compounds of the type of heatproof enamels is carried out with the help of conventional paint-sprayers, with the temperature of the ambient air being higher than 0° C and relative humidity not higher than 80%. The surface of the gunite coating 7 does not need preliminary preparation either. The thickness of the sprayed gastight layer 8 depends on the value of the surplus pressure of the air blast. Said layer 9 made of an elastic soft and readily-strained material, for example, of kaolin wool reliably protects the gastight layer 8 from mechanical damages both in the process of the erection of the refractory lining and in the process of the operation of said stove 1.

Thus, a more reliable protection of the inner surface of said metal jacket 1' against the impact of corrosive condensates is ensured.

What we claim is:

1. A stove of a blast furnace comprising a metal jcket; a gunite on the inner surface of said jacket; a gastight cover in the form of a layer sprayed on the surface of said gunite coating, said layer being selected from the group consisting of metals and heatproof synthetic materials; heat-insulating layers adjacent to said gastight cover from the inner side of the stove; and refractory layers positioned over said heat-insulating layers from the inner side of the stove.

2. The stove of claim 1 wherein the heat-insulating layer immediately adjacent to the gastight cover is made of a soft elastic material.

3. The stove of claim 2 wherein the heat-insulating layer immediately adjacent to the gastight cover is made of kaolin wool.

4. The stove of claim 1 wherein said gunite comprises mortar, cement and asbestos.

* * * * *